US006749425B1

(12) United States Patent
Nakayama

(10) Patent No.: US 6,749,425 B1
(45) Date of Patent: Jun. 15, 2004

(54) INDIRECT HEATING FURNACE

(75) Inventor: Michio Nakayama, Machida (JP)

(73) Assignees: JP Steel Plantech Co., Yokohama (JP); Yoshizawa Lime Industry Co., Ltd., Aso-gun (JP); Merichem Company, Houston, TX (US)

( * ) Notice: Subject to any disclaimer, the term of this patent is extended or adjusted under 35 U.S.C. 154(b) by 0 days.

(21) Appl. No.: 10/400,009

(22) Filed: Mar. 26, 2003

(51) Int. Cl.[7] ..... F27B 19/00
(52) U.S. Cl. ..... 432/118; 432/107; 432/171
(58) Field of Search ..... 432/107, 108, 432/118, 146, 171, 188, 223; 110/242, 257, 258, 342

(56) References Cited

U.S. PATENT DOCUMENTS 3,805,406 A * 4/1974 Castonoli ..... 34/109
4,084,521 A * 4/1978 Herbold et al. ..... 110/242
4,376,343 A * 3/1983 White et al. ..... 34/109
5,393,225 A * 2/1995 Freiberger et al. ..... 432/103
5,846,072 A 12/1998 Willis
5,899,689 A * 5/1999 Fontana ..... 432/180
6,042,370 A * 3/2000 Weide ..... 432/103

* cited by examiner

*Primary Examiner*—Gregory A. Wilson
(74) *Attorney, Agent, or Firm*—Frishauf, Holtz, Goodman & Chick, P.C.

(57) ABSTRACT

An indirect heating furnace heats a substance in a reaction tube with a high-temperature combustion gas without contact between the substance and the combustion gas. The reaction tube is a stationary ceramic tube. A combustion device for supplying said heating high-temperature combustion gas into the furnace in comprised of at least one pair of regenerative burners.

5 Claims, 3 Drawing Sheets

INDIRECT HEATING FURNACE

BACKGROUND OF THE INVENTION

1. Field of the Invention

The present invention relates to an indirect heating furnace suitable for heat treatment of solid inorganic substances, more particularly, for high-temperature heat treatment in cases where direct contact of the solid inorganic substance with high-temperature combustion gas is unfavorable.

2. Description of the Related Arts

In a solid heating process in which direct contact of a substance to be heated with high-temperature combustion gas is unfavorable, an indirect heating furnace (also called an external heating furnace) is generally used.

However, conventional Indirect heating furnaces use metallic shells for reaction tubes. This limits the conventional indirect heating furnace to heating processes requiring temperatures no higher than 900° C.

To overcome this problem, U.S. Pat. No. 5,846,072 (Patent Literature 1) has described that an indirect heating furnace in which the reaction tube is made of ceramics and a screw conveyor is provided in the reaction tube to convey a solid substance to be heated, by which the Indirect heating furnace can be applied to processes requiring temperatures above 900° C.

FIG. 4 shows an example of a general system configuration in the case where a substance to be heated is heat-treated using such an indirect heating furnace provided with a ceramic reaction tube. In the example shown in FIG. 4, a case where lime is burned (thermal decomposition of limestone) is illustrated.

In FIG. 4, limestone charged into a supply chamber 120 through a raw material charge port 110 is transferred in a reaction tube 140 by the rotation of a screw conveyor 130, and conveyed into an outlet chamber 150. The limestone is subjected to heat treatment during the time when it is passed through the reaction tube 140 toward the outlet chamber 150. The heat-treated product in the outlet chamber 150 is discharged to the outside of the furnace through a chute 160.

Outside the tube, high-temperature combustion gas, which is generated by a combustion burner 170, is introduced into the furnace through a gas introduction port 180 to heat the limestone in the reaction tube 140 indirectly via the wall of the reaction tube 140, and is discharged from the furnace through an exhaust port 190. The furnace exhaust gas discharged through the exhaust port 190 is sent to an air preheater 200 to preheat combustion air supplied to the combustion burner 170, by which the heating value of the furnace exhaust gas is utilized effectively.

In the indirect heating furnace as shown in FIG. 4, heating is accomplished in three steps, in that heat is transferred from the high-temperature combustion gas supplied into the furnace to the outside wall of the reaction tube 140, it is conducted through the tube wall, and then the heat is transferred from the tube wall to limestone, which is a substance to be heated. Because of this, the heat transfer efficiency is poor, and the temperature of furnace exhaust gas is as high as about 1000° C. In order to preheat the combustion air using a conventional metallic air preheater 200 with this high-temperature furnace exhaust gas, it is necessary first to lower the gas temperature to about 800° C. by using dilution air to prevent the air preheater from being burned out.

When furnace exhaust gas of about 800° C. is used, the temperature of the obtained preheated air is about 600° C. at the most. Therefore, the heat recovery efficiency is poor, and a large amount of excess heat is wasted. It might be thought that this excess heat can be used to preheat limestone, which is a substance to be heated. However, since this system is used for a process in which direct contact of the substance to be heated with high-temperature combustion gas is unfavorable, the preheating of the substance should also be accomplished indirectly. Thus, it is difficult to improve the thermal efficiency in this way. Further, the amount of exhaust gas discharged from the system increases due to the dilution air, which results in a further increase in heat loss.

SUMMARY OF THE INVENTION

It is an object of the present invention to provide an indirect heating furnace which can improve the thermal efficiency dramatically and can increase the throughput significantly in a solids heating process in which direct contact of the solids with high-temperature combustion gas is unfavorable.

To achieve the above object, the present invention provides the following indirect heating furnaces:

[1] An indirect heating furnace for heating a substance in a reaction tube with a high-temperature combustion gas that does not contact that substance, characterized in that the heating takes place in a stationary ceramic reaction tube, and the combustion device supplying the heating high-temperature combustion gas into the furnace is comprised of at least one pair of regenerative burners.

[2] The indirect heating furnace as described in the above item [1], characterized in that the temperature of the high-temperature combustion gas supplied into the furnace is 1000° C. or higher.

[3] The indirect heating furnace as described in the above item [1] or [2], characterized in that the furnace has a screw conveyor for transporting the substance to be heated through the reaction tube, and the essential portion of the screw conveyor is made of ceramics.

DETAILED DESCRIPTION OF THE PREFERRED EMBODIMENTS

Figure 1:
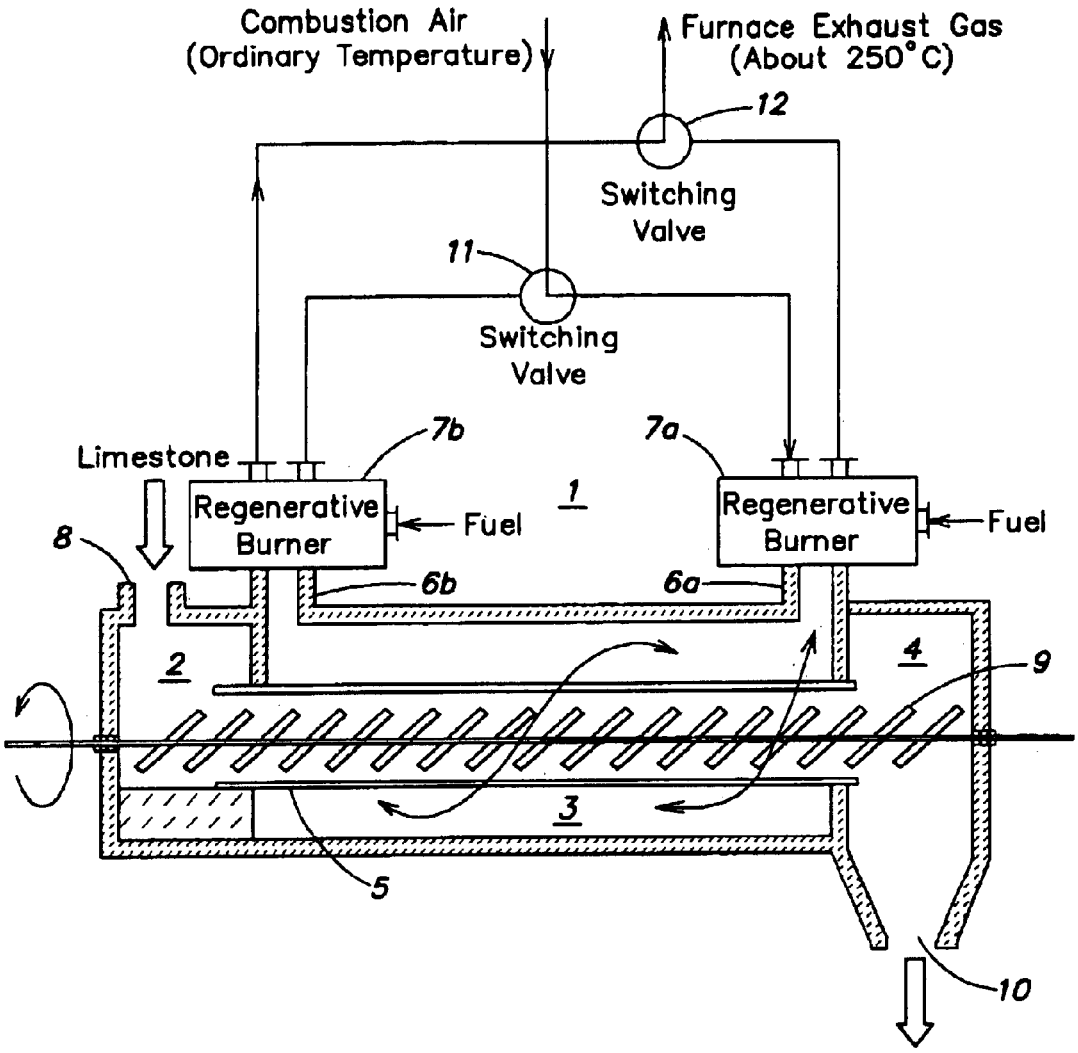
FIG. 1 is a schematic configuration view showing one embodiment of an indirect heating furnace in accordance with the present invention.

FIG. 1 is a schematic configuration view showing one embodiment of an indirect heating furnace in accordance with the present invention.

An indirect heating furnace 1 shown in FIG. 1 includes a solid supply chamber 2 into which a solid inorganic substance, which is a substance to be heated, is charged, a heating chamber 3 into which high-temperature combustion gas is supplied, and a product outlet chamber 4 from which a heated product is discharged to the outside of furnace.

In the heating chamber 3, a ceramic reaction tube 5 is arranged to heat the substance to be heated. One end of the reaction tube 5 communicates with the solid supply chamber 2, and the other end thereof communicates with the product outlet chamber 4. The reaction tube 5 is mounted by being fixed on refractories such as fiber block or castable forming the furnace wall of the heating chamber 3, and the inside of the reaction tube 5 and the heating chamber outside the tube are isolated from each other in a gastight manner.

At introduction/exhaust ports 6*a* and 6*b*, a pair of regenerative burners 7*a* and 7*b* are provided, respectively, to furnish the heating gas to heating chamber 3. The regenerative burner includes two burners in each set, and the number of sets of provided burners can be changed appropriately according to the scale, operating condition, etc. of the furnace.

The ceramic reaction tube 5 is stationary. Conventionally, a horizontal cylindrical kiln (furnace) in which a metallic shell is used as a reaction tube, is constructed so that the reaction tube is inclined at an angle of 2 to 5 degrees, and by rotating the reaction tube, a content (solid to be heated) is heated while being conveyed toward the outlet. However, in a horizontal cylindrical kiln (furnace) using a ceramic reaction tube, it In difficult to rotate the reaction tube due to strength and deformation tolerance. As an alternative, the reaction tube is not rotated but fixed in a stationary position. The content (solid to be heated) is conveyed by a ceramic screw conveyor provided on the inside, not by rotation of the reaction tube.

As the solid inorganic substance, which is a substance to be heated, for example, ore (octahedrite, bauxite, borax, calcite, chalcopyrite, chromite, hematite, etc.), metal halide (calcium bromide, calcium chloride, calcium fluoride, calcium iodide, similarly, iron (III) halide, iron (II) halide, potassium halide, sodium halide, etc.), metal carbide and metal carbonate (calcium carbonate, etc.), metal oxide (chromite, etc.), metal phosphate (calcium phosphate, etc.), and metal sulfide and metal sulfate (calcium sulfate, etc.) can be cited.

The ceramic reaction tube 5 may be formed of, for example, high-purity MgO, high-purity alumina, silicon carbide, beryllia, silicon nitride, boron carbide, or any other ceramic material having relatively high thermal conductivity.

The following is a description of a case where lime is burned (thermal decomposition of limestone) using the indirect heating furnace 1 shown in FIG. 1.

In FIG. 1, limestone charged into the solid supply chamber 2 through a raw material charge part 8 is transported through the reaction tube 5 by the rotation of a screw conveyor 9, and it is dropped into the product outlet chamber 4. The limestone is subjected to heat treatment during the time when it is passing through the reaction tube 5. The heated product in the product outlet chamber 4 is discharged from the furnace through a chute 10.

Outside the tube, high-temperature combustion gas, which is generated by the regenerative burner 7*a*, is introduced into the heating chamber 3 through the gas introduction/exhaust port 6*a* to heat the limestone in the reaction tube 5 indirectly via the wall of the reaction tube 5. It is discharged from the furnace through the gas introduction/exhaust port 6*b* and the regenerative burner 7*b* as a furnace exhaust gas.

The screw conveyor 9 is preferably made of ceramics so that it does not burn out. Thus, even when a heating gas of a high temperature is used, the substance to be heated can be transferred stably. Any of the same ceramics material of construction listed for the reaction tube 5 can be used for the screw conveyor parts, except that relatively lower thermal conductivities are preferred for this service.

The following is a description of a method for Introducing high-temperature combustion gas into the heating chamber 3 by using the paired regenerative burners 7*a* and 7*b*.

Combustion air of ordinary temperature, which is blown by a blower, not shown, or the like, is introduced to the regenerative burner 7*a* through a switching valve 11. The combustion air introduced into the regenerative burner 7*a* passes through a heat reservoir that was heated to a high temperature in the previous cycle. During this time, it is heated to nearly that temperature by the heat stored in the heat reservoir. The heated combustion air is mixed with a fuel supplied separately into the regenerative burner 7*a*, and the high-temperature gas generated by the combustion is introduced into the heating chamber 3 through the gas introduction/exhaust port 6*a*. Some combustion also occurs in the heating chamber 3.

A ceramic having high heat capacity is the preferred material for the heat reservoir.

The high-temperature combustion gas introduced into the heating chamber 3 heats limestone in the reaction tube 5 indirectly via the wall of the reaction tube 5, and subsequently is discharged from the furnace through the gas introduction/exhaust port 6*b*, the regenerative burner 7*b*, and switching valve 12 as the furnace exhaust gas. The gas being discharged through the gas introduction/exhaust port 6*b* passes through a heat reservoir in the regenerative burner 7*b*. At this time, the furnace exhaust gas gives sensible heat to the heat reservoir to heat the heat reservoir to a high temperature, and the temperature of the furnace exhaust gas itself decreases.

After the system has been operated in this state for a predetermined period of time, the flow of gas is reversed by revering the switching valves 11 and 12. For example, combustion air of ordinary temperature, which is blown by a blower or the like, is introduced to the regenerative burner 7*b* through the switching valve 11. This air passes through the heat reservoir that was heated in the previous cycle and during the passage, it is heated to a high temperature by the heat stored in the heat reservoir. The heated combustion air is mixed with a fuel supplied separately into the regenerative burner 7*b*, where combustion produces high temperature gases that are introduced into the heating chamber 3 through the gas introduction/exhaust port 6*b*. The high-temperature combustion gas in the heating chamber 3 heats limestone inside the reaction tube 5 indirectly via the tube wall, and subsequently this is discharged from the furnace through the gas introduction/exhaust port 6*a*, the regenerative burner 7*a*, and the switching valve 12 as furnace exhaust gas. This gas also passes through the heat reservoir in the regenerative burner 7*a*. At this time, the furnace exhaust gas gives sensible heat to the heat reservoir, thus heating the heat reservoir to a high temperature, and the temperature of the furnace exhaust gas itself decreases.

Thus, one of the paired regenerative burners is used for combustion, while the other is used for heat reserve, and the role of the regenerative burners is switched over at time intervals of about 20 to 30 seconds. Thereby, the combustion air supplied to the burner of the combustion side always passes through a hot heat reservoir, so that the air is preheated to high temperatures. The preheated air reaches temperatures only about 50 to 60° C. lower than the temperature of the furnace exhaust gas. That is to say, when the temperature of furnace exhaust gas is about 1100° C., preheated air of about 1050° C. can be obtained, so that the thermal efficiency increases significantly. Further, by heating the combustion air to high temperature, its reactivity with fuel is improved greatly, which also contributes to the stability of combustion. As a result, the concentration of nitrogen oxides generated by combustion in the regenerative burner can be kept at a very low level.

Another advantage in using the regenerative burner is that, because the flow of gas in the heating chamber 3 is reversed at predetermined time intervals, gas mixing in the heating chamber 3 is promoted, and hence the temperature distribution in the combustion chamber 3 can be uniformly high. As a result, the heat transferred to the substance to be heated per unit length of the reaction tube 5 increases greatly as compared to the conventional heating methods that don't use regenerative burners. Therefore, when the throughput is equal, the furnace size can be decreased. Or, when the furnace size is equal, the throughput can be increased significantly.

The time interval for switching over the regenerative burners can be changed appropriately according to the number of sets of provided regenerative burners, the scale and operating condition of furnace, and the like.

The high-temperature combustion gas supplied from the regenerative burner 7*a* (or 7*b*) into the heating chamber 3 preferably has a temperature of 1000° C. or higher, so that heating of the substance to be heated, which is based on radiant heat transfer, can be accomplished more effectively. Also, the temperature of the heat reservoir due to the furnace exhaust gas will be correspondingly high, increasing the preheated temperature of the combustion air, and hence the combustion efficiency is further improved.

The upper temperature limit of the combustion gas in determined by the heat resistance of the ceramic reaction tube 3, which can be 1500° C. or even higher.

For the regenerative burner, besides the switch-over type in which two burners are used in a pair, another method can be used, wherein heating of combustion air and heat recovery from the furnace exhaust gas are accomplished with one burner by turning the heat reservoir in the burner.

EXAMPLE

Figure 2:
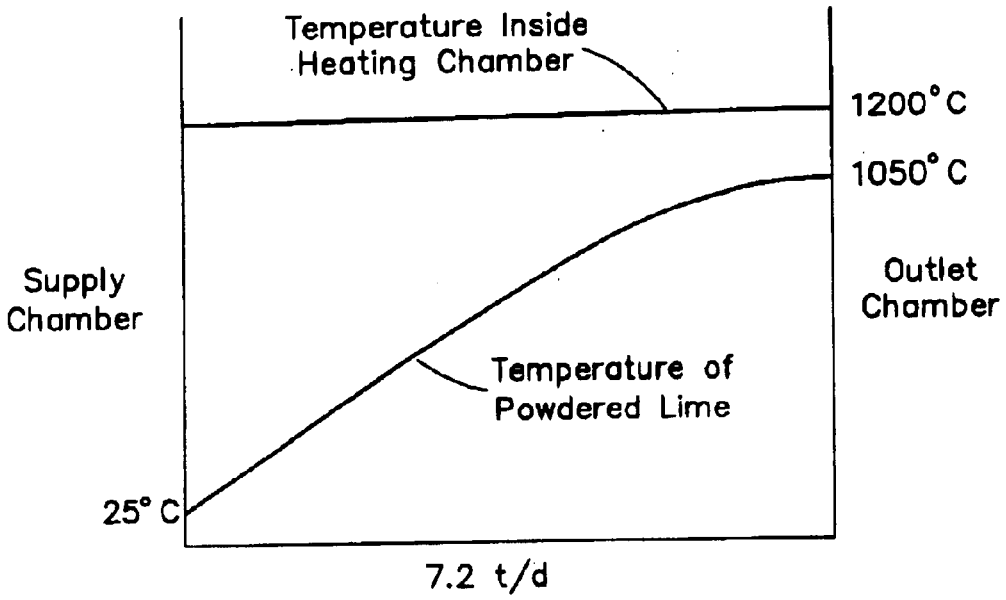
FIG. 2 is a graph showing the measurement results of temperature distribution in a heating chamber and temperature distribution of powdered lime in a reaction tube in the case where powdered lime is burned by using the indirect heating furnace in accordance with the present invention shown in FIG. 1, as an example.

FIG. 2 shows the measurement results of temperature distribution in the heating chamber 3 and temperature distribution of powdered lime in the reaction tube 5 in the case where powdered lime is burned by using the indirect heating furnace configured as shown in FIG. 1, as an example.

In this example, two sets of regenerative burners were provided, and the switching-over of the regenerative burners was accomplished at time intervals of 20 seconds. As a result, the temperature inside the heating chamber 3 was kept substantially uniform at about 1200° C. by the heat storage effect of refractories forming the furnace wall.

In burning powdered lime, the throughput was controlled so that the temperature of powdered lime going to the product outlet chamber was 1050° C.

As a result, the throughput reached 7.2 tons per day. Also, the fuel combustion rate during burning was 37 kg/h of kerosene, and the heat unit requirement per product unit mass at this time was 5600 kJ/kg.

Figure 3:
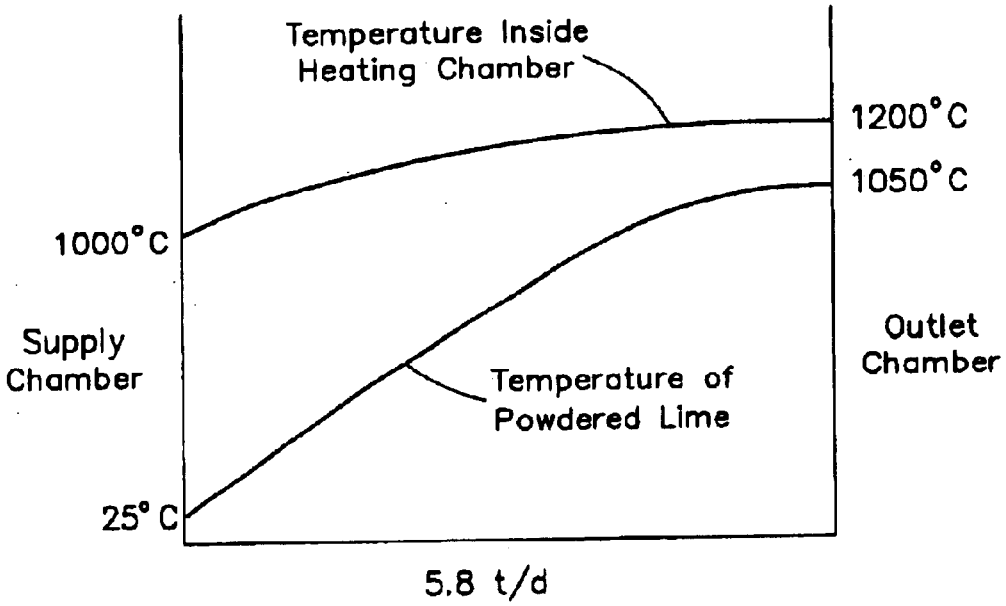
FIG. 3 is a graph showing the measurement results of temperature distribution in a heating chamber and temperature distribution of powdered lime in a reaction tube in the case where powdered lime is burned by using the indirect heating furnace of the related art shown in FIG. 4, as a comparative example.
Figure 4:
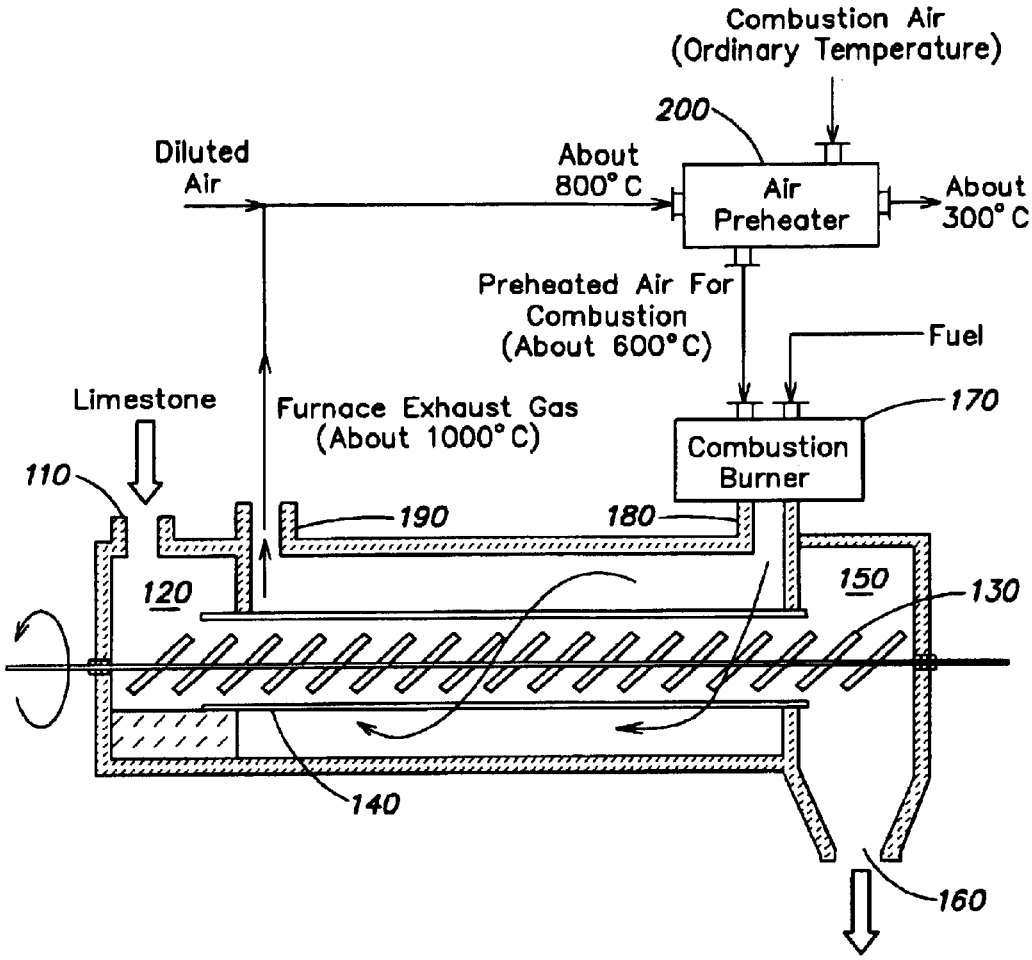
FIG. 4 (PRIOR ART)
FIG. 4 is a schematic view showing one example of general system configuration in the case where a substance to be heated is heat-treated using an indirect heating furnace of the related art which is provided with a ceramic reaction tube.

FIG. 3 shows the measurement results of temperature distribution in the heating chamber 3 and temperature distribution of powdered lime in the reaction tube 5 in the case where powdered lime is burned by using the indirect heating furnace of the related prior art shown in FIG. 4, as a comparative example.

The temperature distribution in the heating chamber 3 is such that the furnace inlet temperature from the combustion burner 170 is about 1200° C., and the furnace gas exit temperature is about 1000° C.

In burning powdered lime, as in the case of the previous example, the throughput was controlled so that the temperature of powdered lime going to the outlet chamber was 1050° C.

As a result, the throughput was 5.8 tons per day. Also, the fuel consumption rate was 40 kg/h of kerosene, and the heat unit requirement per product unit mass in this case was 7500 kJ/kg.

As described above, in the indirect heating furnace in accordance with the present invention, it was confirmed that the thermal efficiency can be improved dramatically as compared with the conventional configuration (unit heat requirement was improved from 7500 kJ/kg to 5600 kJ/kg) and further the throughput can be increased significantly (from 5.8 t/d to 7.2 t/d).

As described above, the present invention is an indirect heating furnace which can improve thermal efficiency dramatically, and which can increase the throughput significantly, compared to the furnace that is described by U.S. Pat. 5,846,072.

What is claimed is:

1. An indirect heating furnace system for heating a substance in a reaction tube with a high-temperature combustion gas without contact between the substance and the high-temperature combustion gas, said indirect heating furnace system comprising:

an indirect heating furnace including a stationary ceramic tube as the reaction tube, and a combustion device which comprises at least one pair of regenerative burners, wherein each regenerative burner has a heat reservoir and a fuel introduction port, and combustion air is heated to form heated combustion air by introducing the combustion air into the heat reservoir, and the heated combustion air and a fuel supplied through the fuel introduction port are burnt to generate the high-temperature combustion gas, and wherein the high-temperature combustion gas is then supplied into the indirect heating furnace.

2. The direct heating furnace system according to claim 1, wherein the temperature of said high-temperature combustion gas supplied into the furnace is at least 1000° C.

3. The indirect heating furnace system according to claim 1, wherein said indirect heating furnace further comprises a screw conveyor for transporting the substance to be heated through said reaction tube, and said screw conveyor comprises a ceramic material.

4. The indirect heating furnace system according to claim 2, wherein said indirect heating furnace further comprises a screw conveyor for transporting the substance to be heated through said reaction tube, and said screw conveyor comprises a ceramic material.

5. The indirect heating furnace system according to claim 1, further comprising a first switching valve for changing a combustion air flow and a second switching valve for changing a combustion gas flow.

* * * * *